US005697857A

United States Patent [19]

Christian et al.

[11] Patent Number: 5,697,857

[45] Date of Patent: Dec. 16, 1997

[54] PLASTIC HOCKEY STICK BLADE STRUCTURE

[75] Inventors: William D. Christian; Roger A. Christian, both of Warroad, Minn.

[73] Assignee: Christian Brothers, Inc., Warroad, Minn.

[21] Appl. No.: 582,730

[22] Filed: Jan. 4, 1996

[51] Int. Cl.[6] ..... A63B 59/12

[52] U.S. Cl. ..... 473/563

[58] Field of Search ..... 273/67 A

[56] References Cited

U.S. PATENT DOCUMENTS

| | | | |
|---|---|---|---|
| D. 237,514 | 11/1975 | Miller . | |
| D. 264,863 | 6/1982 | Walmsley . | |
| 2,912,245 | 11/1959 | Gardner et al. | 273/67 A |
| 3,458,194 | 7/1969 | Coles | 273/67 A |
| 3,561,760 | 2/1971 | Klay | 273/67 A |
| 3,934,875 | 1/1976 | Easton et al. | 273/67 A |
| 4,076,240 | 2/1978 | Haddad | 273/67 A |
| 4,086,115 | 4/1978 | Sweet, Jr. et al. | 273/67 A |
| 4,754,975 | 7/1988 | Aizawa . | |
| 5,332,212 | 7/1994 | Susi et al. . | |
| 5,354,059 | 10/1994 | Stuff . | |
| 5,429,352 | 7/1995 | Leclerc | 273/67 A |

OTHER PUBLICATIONS

"Ramrod", The Sporting Goods Dealer, pp. 49 & 146, Dec. 1972.

*Primary Examiner*—Mark S. Graham
*Attorney, Agent, or Firm*—Dorsey & Whitney LLP

[57] ABSTRACT

A plastic hockey stick blade integrally formed with a handle or provided as a replacement blade in which the blade is provided with a series of diagonal grooves on both the front and back faces to eliminate friction tape wrap.

17 Claims, 2 Drawing Sheets

PLASTIC HOCKEY STICK BLADE STRUCTURE

BACKGROUND OF THE INVENTION

1. Field of the Invention

The present invention relates generally to a hockey stick blade, and more particularly, to a roller or ice hockey blade constructed of a plastic material and having a structure enabling improved puck control.

2. Description of the Prior Art

Hockey sticks have experienced dramatic changes throughout the years. For example, ice hockey sticks have evolved from a plain wooden stick having a straight blade and handle to a significantly improved stick having a curved blade and being reinforced with fiber glass or the like. Significant evolution has also occurred in construction of the stick itself from sticks in which the handle and blade portions were both constructed of wood and were joined with one another through various processes to form a single, integral unit, to sticks constructed of aluminum or plastic and used with replaceable wooden blades.

Historically, wooden blades, whether integrally joined with a wood shaft and sold as a unit or sold separately as a replacement blade with a plastic or aluminum shaft, were wrapped with friction or other tape. This helped to protect the blade from wear as well as to provide the blade with a high frictional surface to enable the player to better control, pass and shoot the puck.

Hockey sticks have also evolved from being used exclusively in connection with the game of ice hockey to being used for in-line roller or street hockey utilizing a plastic puck or ball. Because of this, some hockey stick manufacturers have begun producing composite or plastic hockey sticks as well as composite or plastic replacement blades. Although many of these plastic sticks and blades are intended primarily for use in in-line roller or street hockey, they also have applicability to ice hockey. These currently existing plastic blades are, for the most part, provided with a relatively smooth face. Thus, the plastic replacement blades currently on the market still need to be taped with friction tape or the like in order to provide the desired frictional surface for controlling, passing, and shooting the puck.

Accordingly, there is a need in the art for a plastic hockey stick blade which eliminates the need for wrapping the same with friction tape or the like, but yet still provides for the desired puck control.

SUMMARY OF THE INVENTION

In contrast to the prior art, the present invention provides a plastic hockey stick blade which can be formed integrally with a plastic handle or can be constructed as a replacement blade. The blade in accordance with the present invention includes a surface design which substantially simulates a stick wrapped with friction tape. Accordingly, the present invention provides a plastic hockey stick blade exhibiting puck control comparable to that of a blade wrapped with friction tape, without the need to wrap the stick.

More specifically, the blade of the present invention includes a series of grooves formed diagonally in the front and back faces of the blade. It has been found that such structure provides a highly desirable frictional surface substantially simulating that of friction tape wrapping for controlling, passing and shooting the puck. The blade of the present invention is also constructed of a material which provides the desired weight, toughness and resiliency and which can be shaped, filed and curved to meet individual specifications.

Preferably, the series of grooves extend from the toe end to the heel end of the blade and extend from the top of the stick diagonally rearwardly toward the bottom. Preferably the series of grooves are sloped or angled relative to the bottom of the blade at an angle less than 90 degrees.

Accordingly, it is an object of the present invention to provide a plastic hockey stick blade having its front and back surfaces provided with a structure simulating that of friction tape wrapping.

Another object of the present invention is to provide a plastic hockey stick blade which does not need to be wrapped with friction tape or the like, yet exhibits highly desirable puck control characteristics.

Another object of the present invention is to provide a plastic hockey stick blade either integrally formed with a plastic shaft or as a replacement blade in which the front and rear faces have a series of spaced grooves to simulate friction tape wrap.

These and other objects of the present invention will become apparent with reference to the drawings, the description of the preferred embodiment and the appended claims.

DESCRIPTION OF THE PREFERRED EMBODIMENT

Figure 1:
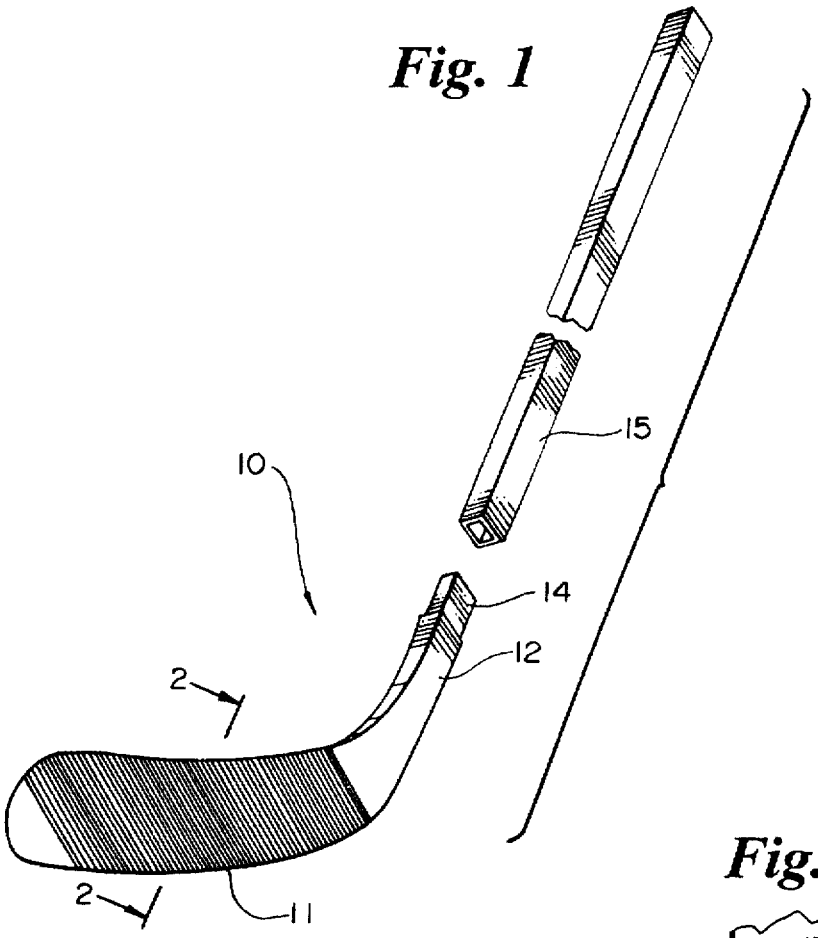
FIG. 1 is broken apart, isometric view of a plastic hockey stick embodying a plastic replacement blade in accordance with the present invention.
Figure 4:
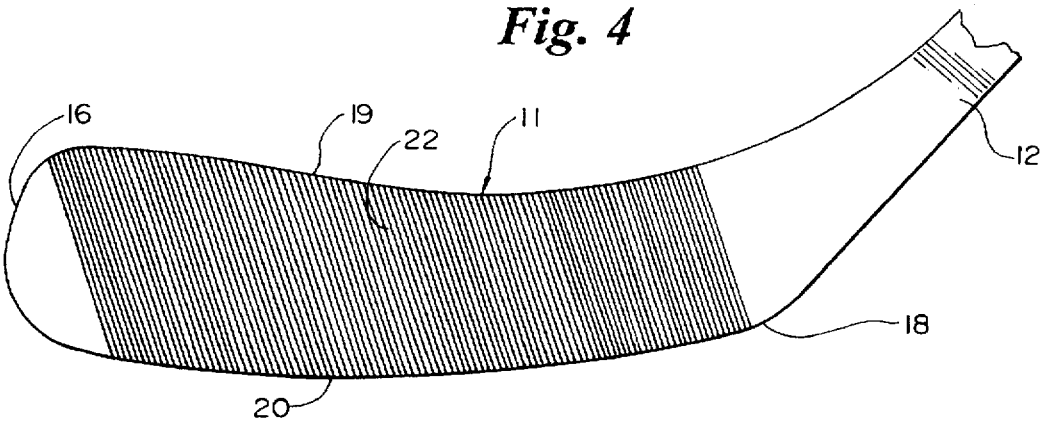
FIG. 4 is an elevational right side view of a hockey stick blade in accordance with the present invention.
Figure 5:
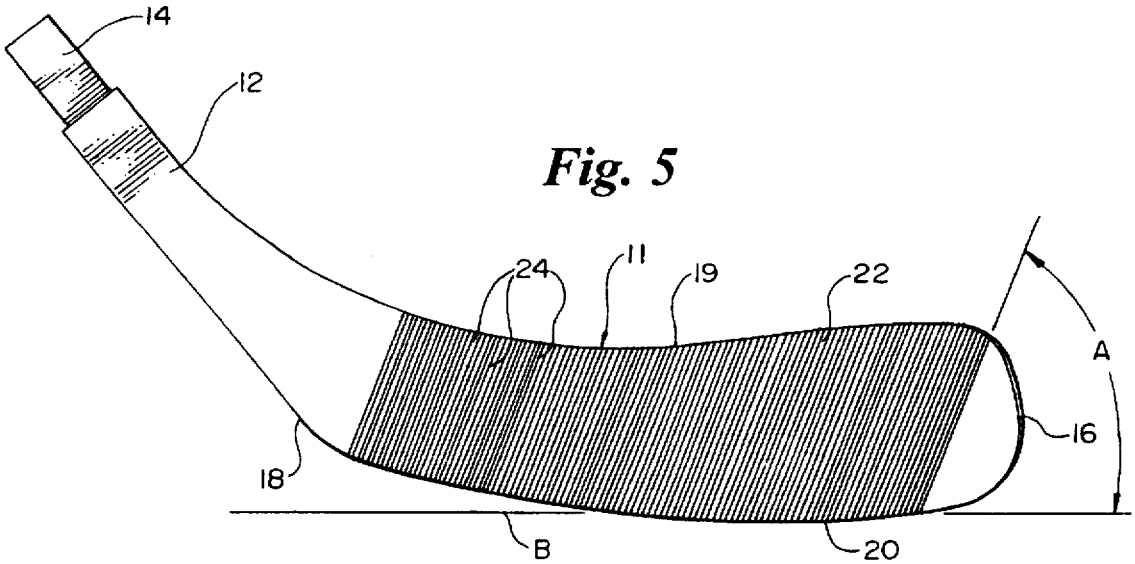
FIG. 5 is an elevational left side view of a hockey stick blade in accordance with the present invention.

FIG. 1 illustrates a plastic hockey stick incorporating the hockey stick blade 10 in accordance with the present invention. As shown, such blade includes a blade portion 11 and a neck or shaft connection portion 12. Because the blade 10 of FIG. 1 is shown as a replacement blade, the outer end of the portion 12 is provided with a tenon 14 adapted for connection with the hollow end of a replacement shaft 15 in a manner known in the art. It should be noted that the blade of the present invention can be provided either as a replacement blade as shown in FIG. 1 or integrally joined with a shaft similar to structures known in the art. As shown best in FIGS. 4 and 5, the blade portion 11 indudes a toe end 16, a heel end 18 and top 19 and bottom 20 edges. The cross sectional configuration of the blade portion 11 is similar to that of hockey stick blades common in the art. Thus, it is relatively thin compared to its height and is substantially of equal thickness throughout, except at its edges. The blade portion 11 is also provided with a front face 21 and a back or rear face 22 as shown in FIGS. 2, 4 and 5.

In accordance with the present invention, both the front 21 and rear 22 faces are provided with a series of spaced grooves 24, or alternating grooves 24 and ribs 26, extending substantially from near the toe end 16 to the heel end 18 and extending throughout the faces of the blade from the top edge 19 to the bottom edge 20. As shown best in FIGS. 1, 4 and 5, the grooves 24, or grooves 24 and ribs 26, extend diagonally relative to the top 19 and bottom 20 edges of the blade and preferably slope from the top edge 19 downwardly and rearwardly toward the bottom edge 20. The specific angle of slope "A" (FIG. 5) of the grooves 24 relative to the top 19 and bottom 20 edges can vary to some degree and still perform the desired function of eliminating the friction tape wrap and providing puck control. Preferably, however, such angle "A" measured relative to the bottom of the blade as defined by the base line "B" is less than 90 degrees. The base line "B" is a straight line forming a tangent approximately at the center of the bottom edge 20. More preferably, angle "A" is between about 30 and 85 degrees and most preferably between 50 and 80 degrees. The most preferable angle for the grooves 24 is about 70 degrees relative to the base line "B".

Although the preferred embodiment shows the grooves 24 as extending from the top edge 19 downwardly and rearwardly toward the bottom edge 20 on both the front 21 and rear 22 faces, it is contemplated that improved frictional benefit will also be achieved from a structure in which the series of grooves 24, or the alternating grooves 24 and ribs 26, extend from the top edge 19 downwardly and forwardly toward the bottom edge 20. The structure illustrated in FIGS. 1, 4 and 5, however, in which the grooves extend downwardly and rearwardly toward the bottom edge 20 is preferred.

Figure 2:
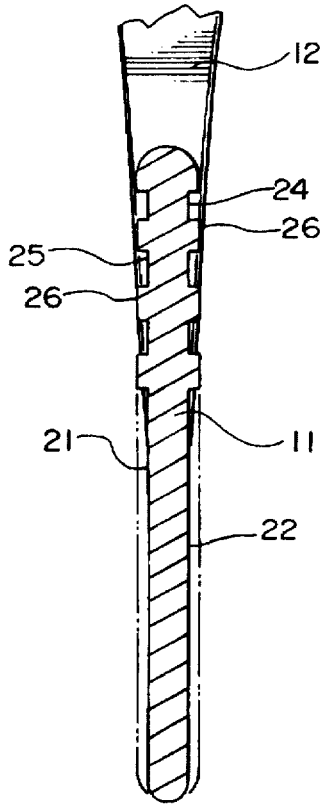
FIG. 2 is a sectional view of the replacement blade of FIG. 1 as viewed along the section line 2—2 of FIG. 1.
Figure 3:
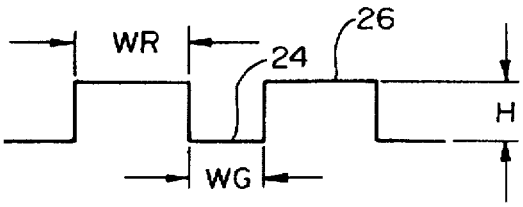
FIG. 3 is an enlarged view of a portion of a face of the hockey blade in accordance with the present invention showing the detailed structure of the series of alternating grooves and ribs.

Reference is next made to FIGS. 2 and 3 showing the details of the groove or groove and rib structure. FIG. 2 is a sectional view as viewed along the section line 2—2 of FIG. 1, while FIG. 3 is an enlarged view of the groove or groove and rib pattern. The surface configuration of each face 21 and 22 of the blade is comprised of a series of spaced grooves 24 or alternating grooves 24 and ribs 26. Preferably the corners of the grooves 24 and ribs 26 are relatively square as shown in FIG. 3; however, each of the corners can have a radius, if desired, for molding tolerances or the like. Further, the width of the groove 24 designated by dimension WG, the width of the rib 26 designated by the dimension WR and the height of the rib 26 (and thus the depth of the groove 24) designated by the dimension H can be varied to some extent without altering the functionality of the structure. Preferably, however, the width of the groove WG is between about 0.030 and 0.090 inches and most preferably about 0.060 inches, the width of the rib WR (or the distance between the grooves 24) is preferably between about 0.070 and 0.130 inches and most preferably about 0.10 inches and the height H of the rib (or depth of the groove) is between about 0.020 and 0.060 inches deep and most preferably about 0.040 inches deep. Preferably, the series of spaced grooves or alternating grooves and ribs extends throughout substantially the entire length of the blade portion 11 from the toe end 16 to the heel end 18. The density of the groove-rib combination measured in a direction parallel to the base line "B" is between about 8 and 20 per inch, more preferably between about 10 to 18 per inch and most preferably between about 12 to 16 per inch.

The blade of the present invention can be manufactured in a variety of ways. The preferred method involves molding the blade and molding the series of spaced grooves or alternating grooves and ribs within the blade portion 11. It is contemplated, however, that the blade portion could be formed smooth and the spaced grooves could be cut into the blade surface via conventional means.

The hockey stick blade in accordance with the present invention can be used either as an ice hockey blade or as an in-line roller or street hockey blade. The material from which the blade 10 is constructed may vary widely; however, the preferred material is a composite graphite or a blend of fiber glass and Nylon to provide desired weight, resiliency, strength and durability to the blade. Such materials also enable the blade to be curved and shaped to meet individual needs and specifications.

Although the description of the preferred embodiment has been quite specific, it is contemplated that various modifications can be made to the preferred embodiment without deviating from the spirit of the present invention. Accordingly, it is contemplated that the scope of the present invention be dictated by the appended claims rather than by the description of the preferred embodiment.

We claim:

1. A hockey blade comprising an integrally formed, one piece plastic blade portion having toe and heel ends, top and bottom edges and front and back faces in which said front and back faces are substantially continuous planar surfaces throughout from said top edge to said bottom edge and in which each of said front and back faces is provided with a series of spaced grooves formed therein and extending from said top edge to said bottom edge substantially throughout the entire length of said blade portion from said toe end to said heel end and spaced from one another by a series of alternating ribs wherein each of said ribs has a generally rectangular cross-sectional configuration, said blade portion including said front and back faces being of the same plastic material throughout.

2. The hockey blade of claim 1 being a replacement blade.

3. The blade of claim 1 integrally joined with a hockey stick shaft forming a hockey stick.

4. The hockey stick blade of claim 1 in which said series of grooves extend diagonally from said top edge to said bottom edge.

5. The hockey stick of claim 4 in which said series of grooves extend from said top edge downwardly and rearwardly toward said bottom edge on both said front and back faces.

6. The hockey stick blade of claim 4 wherein said series of grooves extend upwardly and forwardly relative to said bottom edge at an angle of less than 90 degrees.

7. The hockey stick blade of claim 6 wherein said series of grooves form an angle with said bottom edge of between 30 and 85 degrees.

8. The hockey stick of claim 7 wherein said series of grooves form an angle with said bottom edge of between 50 and 80 degrees.

9. The hockey stick blade of claim 1 being for an ice hockey stick.

10. The hockey stick blade of claim 1 being for an in-line roller or street hockey stick.

11. The hockey stick of claim 7 wherein each of said grooves is parallel to every other groove.

12. The hockey stick of claim 1 wherein each of said grooves is parallel to every other groove.

13. The hockey stick blade of claim 1 having a blade thickness defined by the distance between said front and back faces, a top edge thickness defined by the blade thickness at said top edge and a bottom edge thickness defined by the blade thickness at said bottom edge, said blade thickness being substantially equal throughout said blade portion and said top edge thickness and said bottom edge thickness being no greater than said blade thickness.

14. A hockey blade comprising an integrally formed, one piece plastic blade portion having toe and heel ends, top and bottom edges and front and back faces in which said front and back face are substantially continuous planar surfaces throughout from said top edge to said bottom edge and in which each of said front and back faces is provided with a series of spaced grooves formed therein and extending from said top edge to said bottom edge substantially throughout the entire length of said blade portion from said toe end to said heel end wherein the density of said series of grooves measured in a direction substantially parallel to said bottom edge is between 8 and 20 grooves per inch said blade portion including said front and back faces being of the same plastic material throughout.

15. The hockey stick blade of claim 14 wherein said density of grooves is 10 to 18 per inch.

16. The hockey stick blade of claim 11 wherein the density of said grooves is 12 to 16 per inch.

17. A hockey stick blade comprising an integrally formed, one piece plastic blade portion having toe and heel ends, top and bottom edges and front and back faces in which said front and back faces are substantially continuous planar surfaces throughout from said top edge to said bottom edge and in which each of said front and back faces is provided with a series of spaced grooves formed therein and extending from said top edge to said bottom edge substantially throughout the entire length of said blade portion from said toe end to said heel end, and spaced from one another by a series of alternating ribs wherein each of said grooves includes a groove width and each of said ribs includes a rib width, wherein said rib width is greater than said groove width, said blade portion including said front and back faces being of the same plastic material throughout.

* * * * *